US006352380B1

(12) United States Patent
Haug

(10) Patent No.: US 6,352,380 B1
(45) Date of Patent: Mar. 5, 2002

(54) CASSETTE

(75) Inventor: Werner Haug, Langnau im Emmental (CH)

(73) Assignee: Frama AG, Lauperswil (CH)

( * ) Notice: Subject to any disclaimer, the term of this patent is extended or adjusted under 35 U.S.C. 154(b) by 0 days.

(21) Appl. No.: 09/421,668

(22) Filed: Oct. 20, 1999

(30) Foreign Application Priority Data

Mar. 17, 1999 (CH) ..... 0488/99

(51) Int. Cl.[7] ..... B41J 35/28

(52) U.S. Cl. ..... 400/207; 400/208; 400/208.1; 400/242; 400/248.1; 400/247

(58) Field of Search ..... 400/207, 208, 400/208.1, 242, 247, 248.1, 250

(56) References Cited

U.S. PATENT DOCUMENTS 4,134,693 A * 1/1979 Crickmore et al. ..... 400/208
4,623,274 A * 11/1986 Ohsaki ..... 400/208
4,720,202 A * 1/1988 Kawakami ..... 400/208
5,127,750 A * 7/1992 Burgin ..... 400/208
5,391,007 A * 2/1995 Kulpa ..... 400/208
5,501,536 A * 3/1996 Kleve ..... 400/208
5,714,996 A * 2/1998 Hodai ..... 347/217

FOREIGN PATENT DOCUMENTS

WO 9900255 1/1999

* cited by examiner

*Primary Examiner*—John S. Hilten
*Assistant Examiner*—Minh H. Chau
(74) *Attorney, Agent, or Firm*—Friedrich Kueffner

(57) ABSTRACT

A cassette, particularly for a printing mechanism provided with a thermal printing head, with a ribbon reel and a ribbon take-up reel, includes a housing composed of two wall portions which are spaced apart from each other, wherein the wall portions have grooves, integrally formed indentations or slots, wherein outer portions of the ribbon reel or take-up reel are supported in the grooves or indentations or slots so as to be slidable essentially transversely of the axis of the respective reel.

11 Claims, 2 Drawing Sheets

CASSETTE

BACKGROUND OF THE INVENTION

1. Field of the Invention

The present invention relates to a cassette, particularly for a printing mechanism provided with a thermal printing head, with a ribbon reel and a ribbon take-up reel.

The present invention also relates to a postage meter machine which includes the cassette.

2. Description of the Related Art

Ink ribbons and similar comparatively thin ribbons or tapes are used in a variety of devices, particularly also in postage meter machines. The ribbons usually constitute a material which is used up, i.e., they must be replaced or reloaded from time to time. In order to simplify these maintenance operations, reels onto which the ribbons (usually commercial products) are wound are mounted by the manufacturer in cassettes. The cassettes are then placed by the final user in the respective machine or device which receives the cassette and the cassette is connected to the drive of the device, and the reels are removed from the device after the ribbon material has been used up. When the cassettes and the station which receives the cassette are constructed appropriately, this exchange of cassettes is simple and can be carried out without special knowledge or capabilities.

However, a disadvantage is the fact that the conventional cassettes are usually designed as disposable elements. Since the costs of the cassettes are frequently not negligible in comparison to the ribbon material, and since the disposal of the ribbons may be a burden to the environment, this single use is not optimal. Unfortunately, particularly also those rechargeable cassettes of various types which have already been proposed some time ago do not constitute a suitable replacement for disposable cassettes because they are either too complicated in their construction, unsafe to operate, too cumbersome to use, i.e., particularly during recharging, or they are expensive, particularly with respect to their manufacture.

PCT/CH98/00278 discloses a cassette with an insert device which has made it possible more recently to facilitate by means of an adjustable ribbon guide means the insertion of the thin ribbons used today when inserting them into the cassette in the position of operation without damaging the ribbons. However, this cassette is structurally complicated and expensive as a result.

SUMMARY OF THE INVENTION

Therefore, it is the primary object of the present invention to propose a cassette which does not have the disadvantages mentioned above. It is also an important object that the cassette has a robust and simple construction which facilitates without problems the insertion or removal of a new ribbon or a new ribbon reel. Moreover, a device, particularly a postage meter machine, is to be proposed which because of the exchangeable and rechargeable cassette can be operated easily by the user, does not harm the environment and can be operated economically.

In accordance with the present invention, the cassette includes a housing composed of two wall portions which are spaced apart from each other, wherein the wall portions have grooves, integrally formed indentations or slots, wherein outer portions of the ribbon reel or take-up reel are supported in the grooves or indentations or slots so as to be slidable essentially transversely of the axis of the respective reel.

As a result of the configuration according to the present invention, the cassette acts as a transfer device. For providing the cassette with a new ribbon, the cassette is separated from the device or machine and can be easily provided with a new ribbon reel at a location suitable for this purpose. After actuating a release device, the old reel is moved essentially perpendicularly of the reel axis toward the edge area of the housing and is then removed from the housing. The new reel is then inserted in the opposite direction into the housing. The grooves, integrally formed indentations (e.g., embossments) or slots in the housing walls serve as guide means for the reels or the shafts thereof. Subsequently, the ribbon is guided onto the new empty reel which has also been inserted in the same manner and is attached to the reel in order to be wound up. For this purpose, the ribbon is guided from the full reel over a ribbon guide means and is attached to a ribbon receiving means for winding up the ribbon. The cassette now provided with the fresh ribbon can then be inserted, for example, into the postage meter machine which is equipped to receive the cassette.

The cassette also facilitates a quick exchange of different ribbons which have not yet been completely used up and serves simultaneously as an intermediate storage unit for ribbon reels which have not been completely used up outside of the device intended to receive the ribbon. This also constitutes an effect of the invention which protects the environment.

The cassette utilizes an especially small quantity of material if the housing is composed essentially only of the two spaced-apart wall portions, wherein one of the wall portions may be constructed double-walled for receiving auxiliary means, such as a braking element and/or a mechanism for securing the reels. When the contours of the two walls of this double-walled construction are selected differently, the quantity of material is further reduced.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
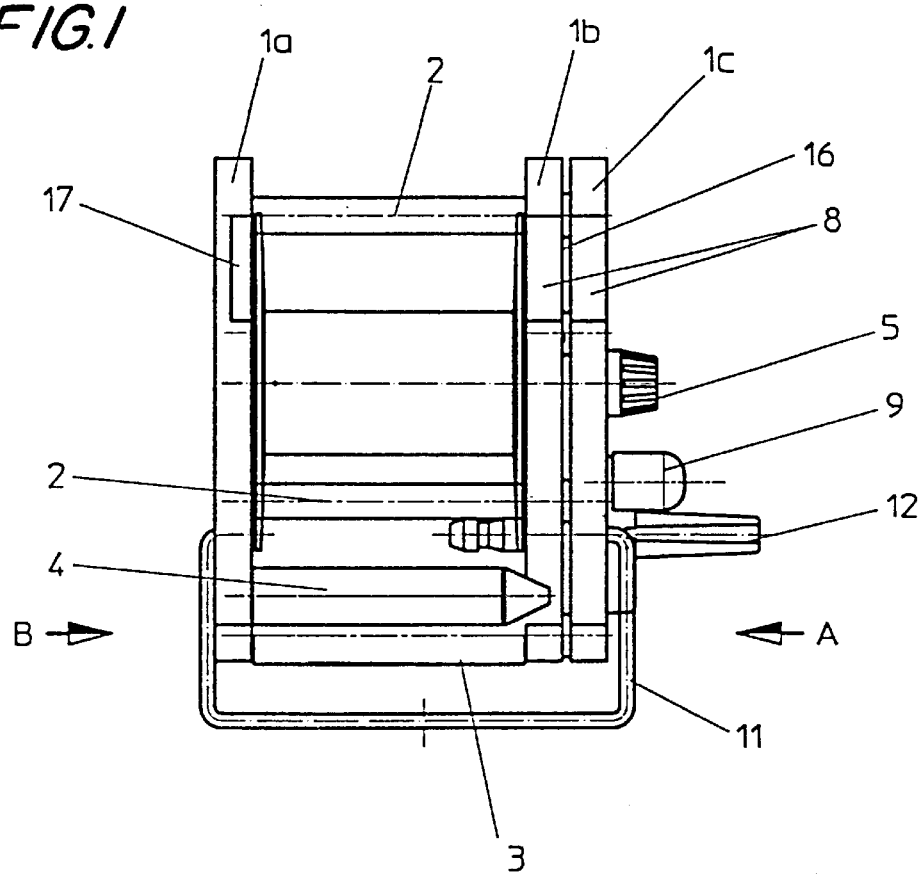
FIG. 1 is a front view of the housing of the cassette according to the present invention.
Figure 2:
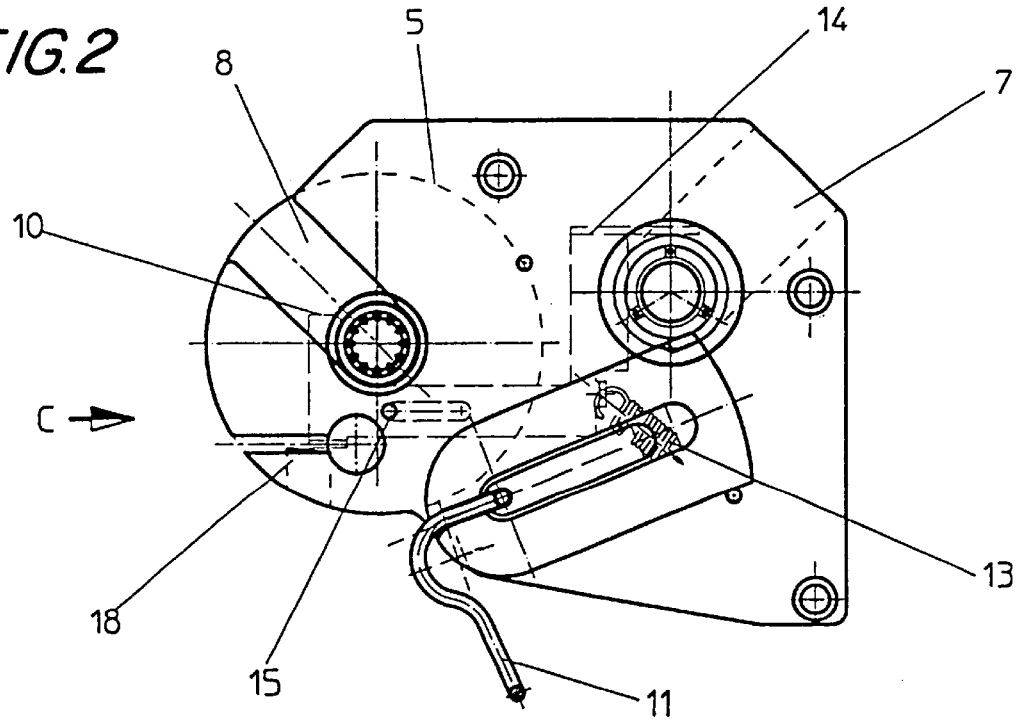
FIG. 2 is a side view of the housing of the cassette as seen in the direction of arrow A of FIG. 1.
Figure 3:
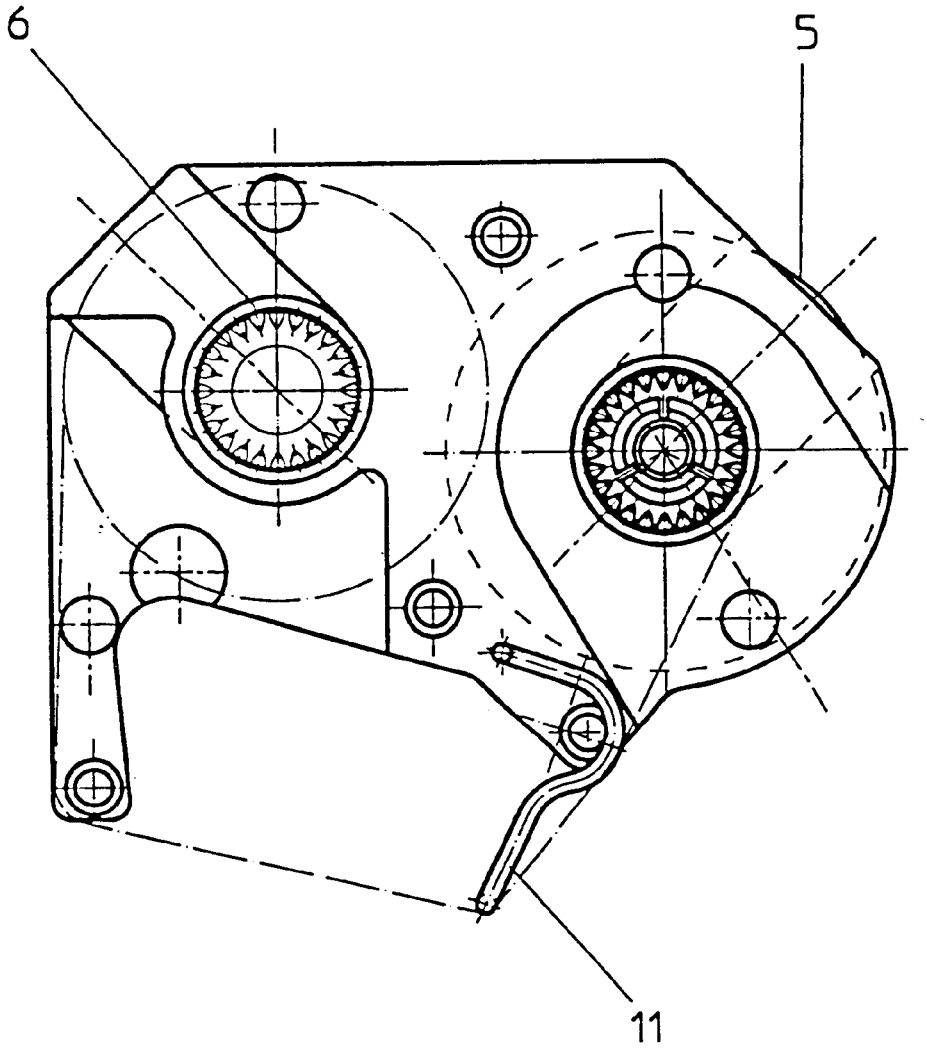
FIG. 3 is another side view of the housing of the cassette as seen in the direction of arrow B of FIG. 1.

As illustrated in the drawing, the housing of the cassette is composed essentially of three flat plates 1*a,* 1*b,* and 1*c* which are connected through webs 2, 3. In the illustrated embodiment, the plates extend parallel to each other. The webs 2 are fixedly connected to the plates, for example, they are cast integrally as one piece, or they are glued or welded to the plates, or they are connected by means of releasable means, such as screws. The webs 3 are constructed as rotatable rollers with shafts connected to the two plates 1*a,* 1*b,* wherein the roller shafts are connected to the plates in the same manner as the webs 2. Consequently, the plates 1 and the web 2, 3 form a stiff cage for receiving the ribbon reel 6 and the ribbon take-up reel 5 or empty reel. Thus, in order to achieve a construction which uses as little material as possible, the housing of the cassette is only composed of the two side walls. The housing does not have any actual wall portions in the direction of the webs, i.e., the cassette is actually open all around with the exception of the webs.

The shafts of the two rollers 5, 6 are supported in grooves 7, integrally formed indentations 7 or slots 8 which extend, as seen from above, obliquely downwardly in the plates 1*a*, 1*b*. The width of the grooves or slots is slightly greater than the reel diameter required at this location. After being inserted into the bottom of the grooves or slots, the shafts drop down as a result of their own weight or can be pushed downwardly by hand. A manually operated retaining mechanism 9 which is provided with a locking member and which is pulled back in the direction of arrow C when the roller is inserted against the force of a spring 13, engages in the released state with its finger 10 in the groove or slot 7, 8 and prevents in this manner the ribbon take-up reel 5 and the ribbon reel 6 from sliding back when the cassette is moved in space, for example, when the cassette is inserted into the device, for example, a postage meter machine. An angle-shaped lug 14 of the retaining mechanism 9 additionally acts as a breaking element.

This pressure acting on the ribbon reel 6 produces a slight braking moment which decelerates the ribbon reel 6 after each pressure application and prevents an impermissible loop formation of the ribbon. The braking force is produced by the spring 13 which is attached to the slide member of the retaining mechanism 9 and to the plate 1*b*. A stop bolt 15 serves as the point of rotation of the slide member. A small plate 18 placed in and screwed to the plate 1*c* makes possible the locking of the sliding member in the release position for the ribbon coil 6 and the pick-up reel 5. This locking mechanism facilitates the removal and insertion of the reels 5 and 6. The sliding member of the retaining mechanism 9 constructed as one piece therefore meets several functions simultaneously and is mounted well protected between the two plates 1*b* and 1*c*.

The ribbon take-up reel 5 includes coupling elements which can be coupled in the conventional manner to a drive unit of the postage meter machine, as disclosed in PCT/CH98/00278 mentioned above. In the illustrated embodiment, the ribbon reel is also provided with a coupling element. The latter coupling element drives together with corresponding coupling elements of the postage meter machine preferably a turning angle sensor, so that the correct ribbon supply can be monitored during operation.

Visible at the plate 1*a* is the insertion groove 7 through which a stub axle of the ribbon take-up reel 5 is inserted. The plate 1*a* has at its lower end a ribbon guide means in the form of a bolt for receiving a ribbon guide roller 4 whose right end is free. This unilateral support is selected in order to make it possible that the ribbon can be guided more easily toward the ribbon take-up reel when it is inserted and the ribbon comes to rest on the side of the roller facing the housing.

The plates 1*b* and 1*c* are screwed together through spacer members 16. The contours of the two plates 1*b* and 1*c* are different in order to save material and weight. Slots 8 are provided in both plates through which the ribbon take-up reel 5 is inserted. An insertion groove may be provided at the ribbon reel 6 in the inner plate 1*b* as well as in the left plate 1*a*. The reason for the different configuration of the ribbon reel guide means is the function of the reels. When the ribbon has the sufficient resistance to tearing, the ribbon wheel can be rotated through the ribbon being pulled off, i.e., the ribbon reel may be without a drive; however, the ribbon reel requires a brake for stopping rotation of the reel. In the illustrated embodiment, the reel is provided with optional coupling elements which drive a turning angle sensor in the postage meter machine. Consequently, the axle of the reel must extend through both wall plates shown on the right-hand side; this can be achieved through the slots. Of course, it is also possible to drive the ribbon reel through a coupling by the postage meter machine. The ribbon take-up reel, on the other hand, requires an external drive which can be realized most easily through a coupling acting on the reel axle. Accordingly, the axle must extend through both plates. However, also conceivable are drive means which act on the sides of the reel, for example, gear wheels or friction wheels. In that case, the ribbon take-up reel could be guided on both sides thereof in grooves.

The ribbon guide means 3 is rigidly connected to the right plate 1*b* and the left plate 1*a*. The ribbon guide means 4, on the other hand, is only connected to the left plate 1*a*. This is because the ribbon must rest with contact on the side facing the interior of the cassette.

A stirrup 11 which is pivotable about the axis of a turning knob 12 has the purpose of enlarging the space between the ribbon and the cassette housing when the cassette is inserted into the machine. The printing head of the machine will be accommodated in this enlarged space. This measure prevents damage to the ribbon when the cassette is inserted. After the cassette is inserted into the machine, the stirrup is pivoted back and allows the ribbon to contact the printing head.

Of course, individual elements of the device can be constructed differently in structural and/or operational respects. It is important that the operation of the elements is maintained in accordance with the framework of the teaching according to the present invention, which is:

The cassette has a structurally very simple construction essentially composed of two side walls and webs connecting the two side walls. The ribbon reel and the take-up reel are guided in grooves, integrally formed indentations or slots in the side walls. This results in an operationally safe mounting and a very simple exchange of the reels.

While specific embodiments of the invention have been shown and described in detail to illustrate the inventive principles, it will be understood that the invention may be embodied otherwise without departing from such principles.

I claim:

1. A cassette particularly for a printing mechanism provided with a thermal printing head, including a ribbon reel and a ribbon take-up reel, the cassette comprising a housing comprised of two wall portions mounted spaced apart from each other, wherein each wall portion has recesses for receiving outwardly protruding portions of the ribbon take-up reel and the ribbon reel so as to be slidable essentially transversely of an axis of each reel, further comprising a lockable mechanism for releasably securing at least one of the reels in an area of ends of the recesses, wherein each reel is configured to be slidable from an open side of the recess freely to the end of the recess, further comprising a retaining slide member with a stop surface for blocking movement of the reels away from the ends of the recesses.

2. The cassette according to claim 1, wherein the recesses are grooves.

3. The cassette according to claim 1, wherein the recesses are integrally formed indentations.

4. The cassette according to claim 1, wherein the recesses are slots.

5. The cassette according to claim 1, wherein one of the wall portions is comprised of two wall parts arranged at a distance from each other which is smaller than a distance between the wall portions, wherein circumferences of the wall parts are not identical.

6. The cassette according to claim 1, further comprising a stirrup pivotally hinged to one of the wall portions, wherein the stirrup is pivotable from one of the wall portions toward another of the wall portions and away from the housing.

7. The cassette according to claim 1, wherein the wall portions are connected to each other through at least one web.

8. A cassette particularly for a printing mechanism provided with a thermal printing head, including a ribbon reel and a ribbon take-up reel, the cassette comprising a housing comprised of two wall portions mounted spaced apart from each other, wherein each wall portion has recesses for receiving outwardly protruding portions of the ribbon take-up reel and the ribbon reel so as to be slidable essentially transversely of an axis of each reel, further comprising spring-actuated braking means for acting on at least one of axles of the reels or on side walls of the reels at the end of the recess.

9. The cassette according to claim 8, wherein at least portions of a retaining slide means and braking means for the reels are mounted so as to be moveable into a space defined between the two wall portions.

10. A postage meter machine comprising a cassette particularly for a printing mechanism provided with a thermal printing head, including a ribbon reel and a ribbon take-up reel, the cassette comprising a housing comprised of two wall portions mounted spaced apart from each other, wherein each wall portion has recesses for receiving outwardly protruding portions of the ribbon take-up reel and the ribbon reel so as to be slidable essentially transversely of an axis of each reel, further comprising a lockable mechanism for releasably securing at least one of the reels in an area of ends of the recesses, wherein each reel is configured to be slidable from an open side of the recess freely to the end of the recess, further comprising a retaining slide member with a stop surface for blocking movement of the reels away from the ends of the recesses.

11. The postage meter machine according to claim 10, wherein at least one of the reels comprises coupling elements for engagement with corresponding coupling elements of the machine, wherein one of the coupling elements drives an incremental sensor for measuring an angle of rotation of the reel.

* * * * *